US006037086A

United States Patent [19]

Gorog et al.

[11] Patent Number: 6,037,086

[45] Date of Patent: Mar. 14, 2000

[54] METHOD OF MANUFACTURING A MATRIX FOR A CATHODE-RAY TUBE

[75] Inventors: Istvan Gorog, Lancaster; Richard LaPeruta, Jr., Lititz; Samuel Pearlman, Lancaster, all of Pa.; Nitin Vithalbher Desai, Princeton Junction; Wilber Clarence Stewart, Hightstown, both of N.J.; Gregory James Cohee, Newtown, Pa.; Richard William Nosker, Princeton, N.J.; Pabitra Datta, deceased, late of Cranbury, N.J., by Flora Borja Datta, executor; Danielle Helene Herford, Etters, Pa.

[73] Assignee: Thomson Consumer Electronics, Inc.,, Indianapolis, Ind.

[21] Appl. No.: 09/097,390

[22] Filed: Jun. 16, 1998

[51] Int. Cl.[7] ..... G03G 13/10

[52] U.S. Cl. ..... 430/25; 430/119

[58] Field of Search ..... 430/25, 28, 24, 430/29, 100, 119

[56] References Cited

U.S. PATENT DOCUMENTS

| | | | |
|---|---|---|---|
| 3,558,310 | 1/1971 | Mayaud | 96/36.1 |
| 4,921,767 | 5/1990 | Datta et al. | 430/23 |
| 5,455,133 | 10/1995 | Gorog et al. | 430/23 |
| 5,519,217 | 5/1996 | Wilbur et al. | 250/326 |
| 5,646,478 | 7/1997 | Nosker et al. | 313/402 |
| 5,744,270 | 4/1998 | Pearlman et al. | 430/25 |
| 5,840,450 | 11/1998 | Cho | 430/25 |

OTHER PUBLICATIONS

A.M. Morrell et al., Color Television Picture Tubes, pp. 80–85 (1974).

*Primary Examiner*—Christopher D. Rodee

*Attorney, Agent, or Firm*—Joseph S. Tripoli; Dennis H. Irlbeck

[57] ABSTRACT

A light-absorbing matrix 23, having openings therein, is formed on an interior surface of a faceplate panel 12 of a cathode-ray tube 10 by providing a photoreceptor thereon, electrostatically charging the photoreceptor 72 to a substantially uniform level of charge, and exposing the photoreceptor to light through openings 33 in a color selection electrode 24 to selectively discharge the more intensely illuminated areas of the photoreceptor, without substantially discharging the less intensely illuminated areas. The photoreceptor 72 comprises a plurality of layers including a photoresist layer 56, a conductive layer 62, and a photoconductive layer 66. The openings 33 in the color selection electrode 24 have a dimension substantially greater than the dimension of the openings in the resultant matrix 23.

The photoreceptor 72 is contacted with a liquid toner having charged pigment particles which form toner lines 84 on the less intensely illuminated areas of the photoreceptor. The photoreceptor 72 is exposed to UV radiation to selectively change the solubility of the photoresist portion 56 thereof into areas of greater and lesser solubility. The photoreceptor 72 is serially developed to expose portions of the interior surface of the panel 12, while leaving the areas of lesser solubility intact. Next, the interior surface of the panel and the areas of lesser solubility are coated with a matrix suspension which is dried to form the matrix 23. The areas of lesser solubility and the overlying light-absorbing matrix material thereon are removed, thereby forming in the matrix 23 a plurality of openings having a width less than the width of the openings 33 in the color selection electrode 24.

14 Claims, 9 Drawing Sheets

METHOD OF MANUFACTURING A MATRIX FOR A CATHODE-RAY TUBE

This invention relates to a method of manufacturing a light-absorbing matrix for a cathode-ray tube (CRT) and, more particularly to a method of making a matrix using a color selection electrode having openings substantially greater in width than the width of the resultant matrix openings.

BACKGROUND OF THE INVENTION

FIG. 1 shows a shadow mask 2 and a viewing faceplate 18 of a conventional CRT screen surface having a screen assembly 22 thereon. The shadow mask 2 includes a plurality of slits, or rectangular openings, 4 only one of which is shown. The screen assembly 22 includes a light-absorbing matrix 23 with rectangular openings in which blue-, green-, and red-emitting phosphor lines, $P_b$, $P_g$ and $P_r$, respectively, are disposed. Three color-emitting phosphors and the matrix lines, or guardbands, therebetween comprise a triad having a width, or screen pitch, T, of about 0.84 mm (33 mils). The guardbands are designated hereinafter as RB, for the guardbands between the red- and blue-emitting phosphor lines; RG, for the guardbands between the red- and green-emitting phosphor lines; and BG, for the guardbands between the blue- and green-emitting phosphor lines. For the conventional shadow mask 2, the mask openings 4 have a width, a, not greater than one third the width, T, of the triad. In a CRT having a diagonal dimension of 51 cm (20 inches), the width, a, of the shadow mask openings 4 are on the order of about 0.23 mm (9 mils) and the resultant openings formed in the matrix have a width, c, of about 0.18 mm (7 mils). The guardbands of the matrix 23, between the adjacent phosphor lines, have a width, d, of about 0.1 mm (4 mils). The matrix 23, preferably, is formed on the viewing faceplate 18 by the process described in U.S. Pat. No. 3,558,310, issued to Mayaud on Jan. 26, 1971. Briefly, a film of a suitable photoresist, whose solubility is altered by light, is provided on the interior surface of the viewing faceplate 18. The photoresist film is exposed, through the openings 4 in the shadow mask 2, to ultraviolet light from a conventional three-in-one lighthouse, shown schematically in FIG. 2. With the shadow mask 2 in place, the photoresist film is exposed sequentially and equally (6 exposures units (wgt) each, for example) by each of the light sources. The shadow mask openings 4 have a periodic pitch, $D_m$, and the design value of the mask-to-screen spacing is $Q=Q_0$. It is desired that the light paths from the three sources, R, G and B, mimic the electron beam paths from the three electron guns of the CRT. Therefore, the light sources R, G and B are spaced a distance, L, from the screen, at the effective center of deflection of the gun-yoke system, and are laterally spaced by the same distance, s, as the electron beam centers in the deflection plane. The "G" source lies on the symmetry axis of the screen and mask.

After the matrix exposure process is completed, the regions of the photoresist film with greater solubility are removed by flushing the exposed film with water, thereby uncovering bare areas of the faceplate. Next, the interior surface of the faceplate panel is overcoated with a black matrix slurry, of the type known in the art, which, when dried, is adherent to the uncovered areas of the faceplate. Finally, the matrix material overlying the retained film regions, as well as the retained film regions, are removed, leaving the matrix guardbands on the previously uncovered areas of the faceplate panel. The positions on the screen surface denoted by b, g and r in FIG. 2, are the centers of the projected slit images. The matrix guardbands are in the area of least light exposure, midway between the slit images. From the exposure geometry, the design value of the triad pitch, T, at the screen, based on the projected slit images from a single light source, is given by:

$$T=(L/(L-Q_0))\times D_m. \quad (1)$$

In order to obtain the required value of T/3 for the distance from g to b, and for the distance from r to g at the screen, the condition, $$s=LD_m/3Q_0 \quad (2)$$

must be met, where "s" is the lateral spacing between the light sources in the lighthouse, as shown in FIG. 2.

Again with reference to FIG. 1, the difference between the width, a, of the shadow mask openings and the width, c, of the matrix openings is referred to as "print down." Thus, in the conventional shadow mask-type CRT, having mask openings with a width of 0.23 mm and the matrix openings with a width of 0.18 mm, the typical "print down" is about 0.05 mm (2 mils). A drawback of the shadow mask-type CRT is that, at the center of the screen, the shadow mask intercepts all but about 18–22% of the electron beam current; that is, the shadow mask is said to have a transmission of only about 18–22%. Thus, the area of the openings 4 in the shadow mask 2 is about 18–22% of the area of the mask. Because there are no focusing fields associated with the shadow mask 2, a corresponding portion of the screen assembly 22 is excited by the electron beams.

In order to increase the transmission of the color selection electrode without increasing the size of the excited portions of the screen, a post-deflection focusing color selection structure is required. The focusing characteristics of such a structure permit larger aperture openings to be utilized to obtain greater electron beam transmission than can be obtained with the conventional shadow mask. One such structure, a uniaxial tension focus mask, is described in U.S. Pat. No. 5,646,478 issued to R. W. Nosker et al. on Jul. 8, 1997. A drawback of using a post deflection color selection electrode, such as a tension focus mask, is that conventional methods for forming the matrix cannot be utilized, because the prior methods provide only about a 0.05 mm (2 mil) "print down." For the tension focus mask of U.S. Pat. No. 5,646,478, the triad period or pitch, T, of the screen assembly is the same as for a CRT with a conventional shadow mask, so the matrix openings are about 0.18 mm wide. However, as described hereinafter, for a tension focus mask-type CRT, a "print down" of about 0.37 mm (14.5 mils) is required. Such a high degree of "print down" cannot be achieved with the conventional matrix process described above. Additionally, for a tension focus mask-type CRT having, for example, 50% mask transmission, any matrix opening patterns formed using a conventional three-in-one lighthouse process, such as that taught by Mayaud, referenced above, will result in misregister of the electron beams which impinge upon the blue- and red-emitting phosphors and also nonparity of the intratrio openings with "Q"-space errors. "Q"-space errors of the order of +/−5%, that is variations in the focus mask-to-screen spacing caused by deviations of the faceplate thickness or curvature from the bogie dimensions, are typical. Accordingly, a new method of making a matrix with the capability for very large "print down" is required.

SUMMARY OF THE INVENTION

The present invention relates to a method of manufacturing a light-absorbing matrix, having a plurality of openings formed therein, on an interior surface of a faceplate panel of a cathode-ray tube. A photoreceptor, having a plurality of layers including a photoresist layer, a conductive layer, and a photoconductive layer, is formed on the interior surface of the panel and electrostatically charged to a substantially uniform level of charge. Then, a color selection electrode having a plurality of openings, substantially greater in a dimension than the corresponding openings in the light-absorbing matrix, is inserted into the panel. The photoreceptor is exposed to light through the openings in the color selection electrode to selectively discharge the more intensely illuminated areas of the photoreceptor, without substantially discharging the less intensely illuminated areas and without substantially irradiating the underlying photoresist. The color selection electrode is removed from the panel after the exposure step, and the photoreceptor is contacted with a suitable liquid toner to form toner lines. The liquid toner comprises pigment particles having a charge opposite in polarity to the charge on the less intensely illuminated areas of the photoreceptor. The color selection electrode is re-inserted into the panel and the photoreceptor is exposed to UV radiation to selectively change the solubility of the photoresist layer thereof, thus creating areas of greater solubility underlying the toner lines and areas of lesser solubility therebetween. The photoreceptor is serially developed to remove the areas with lesser solubility and expose portions of the interior surface of the panel, while leaving intact the areas of lesser solubility. Next, the exposed portions of the interior surface of the panel and the areas of lesser solubility are coated with a matrix suspension and dried to form a matrix. The matrix is developed by contacting it with a solvent to remove the areas of lesser solubility and the overlying light-absorbing matrix thereon, without removing the light-absorbing matrix from the exposed portions of the interior surface of the panel.

DETAILED DESCRIPTION OF THE PREFERRED EMBODIMENTS

Figure 3:
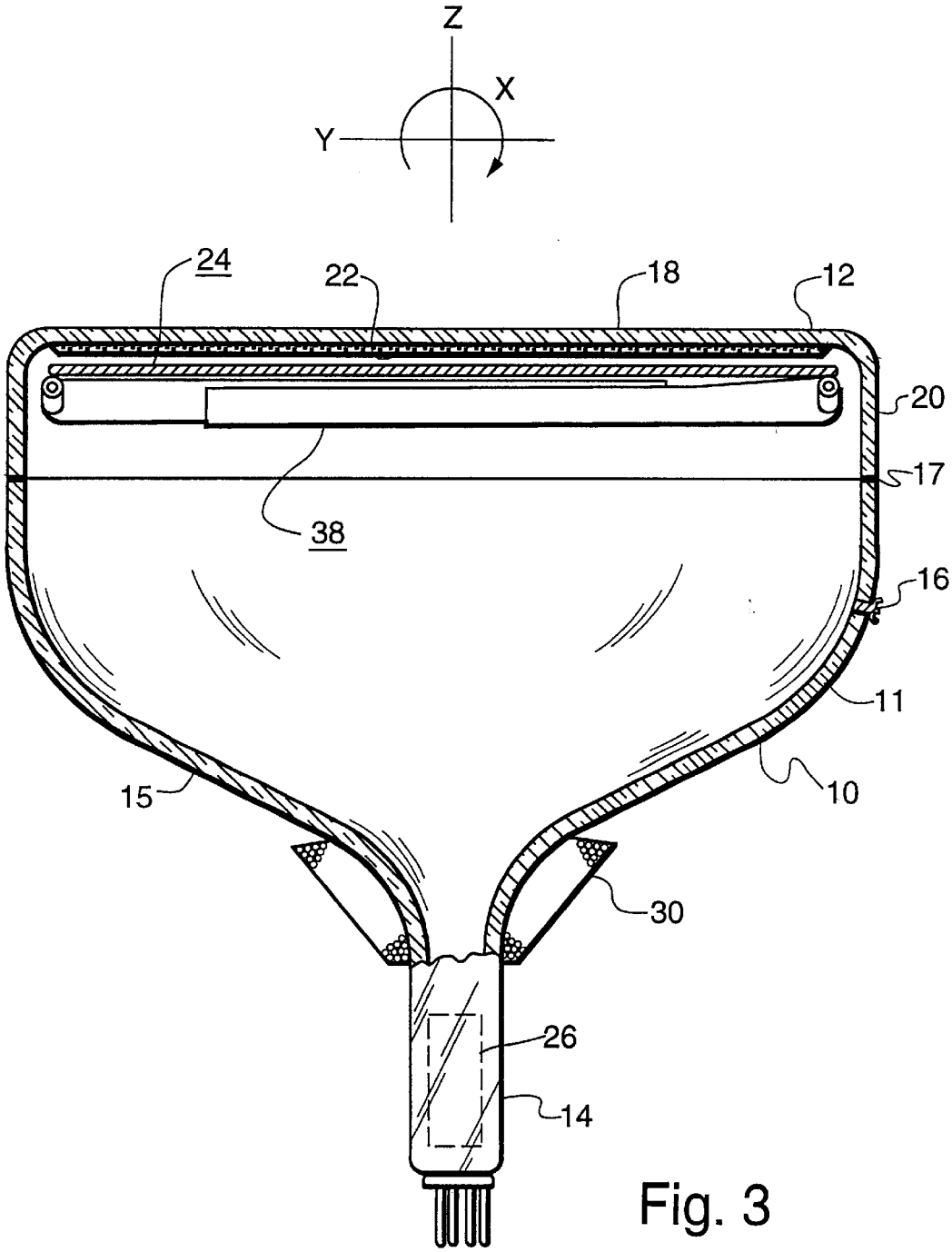
FIG. 3 is a plan view, partly in axial section, of a color CRT made according to the present invention.

FIG. 3 shows a cathode-ray tube 10 having a glass envelope 11 comprising a rectangular faceplate panel 12 and a tubular neck 14 connected by a rectangular funnel 15. The funnel has an internal conductive coating (not shown) that extends from an anode button 16 to the neck 14. The panel 12 comprises a cylindrical viewing faceplate 18 and a peripheral flange or sidewall 20 that is sealed to the funnel 15 by a glass frit 17. A three-color phosphor screen 22 is carried by the inner surface of the faceplate 18. The screen 22 is a line screen with the blue-, green-, and red-emitting phosphors arranged in triads, each triad including a phosphor line of each of the three colors, $P_b$, $P_g$ and $P_r$, separated by opaque lines of a light-absorbing matrix 23, shown in FIG. 4. A cylindrical multi-apertured color selection electrode, such as a tension focus mask, 24 is removably mounted within the panel 12, in predetermined spaced relation to the screen 22. An electron gun 26, shown schematically by the dashed lines in FIG. 3, is centrally mounted within the neck 14 to generate and direct three inline electron beams (also not shown) along convergent paths through the tension focus mask 24 to the screen 22. The electron gun is conventional and may be any suitable gun known in the art.

Figure 4:
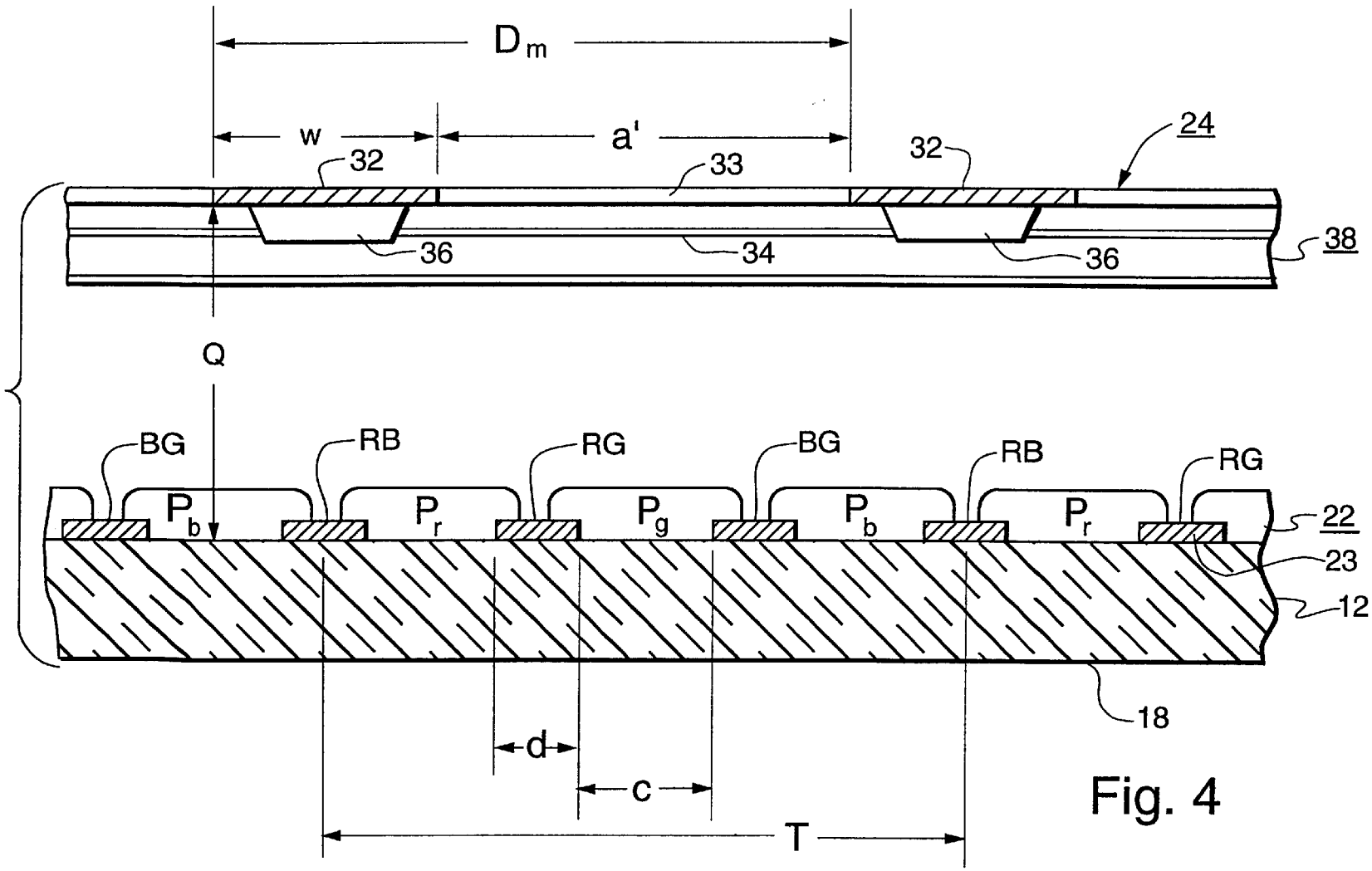
FIG. 4 is an enlarged sectional view of a portion of the tension focus mask and screen of the CRT of FIG. 3.
Figure 5:
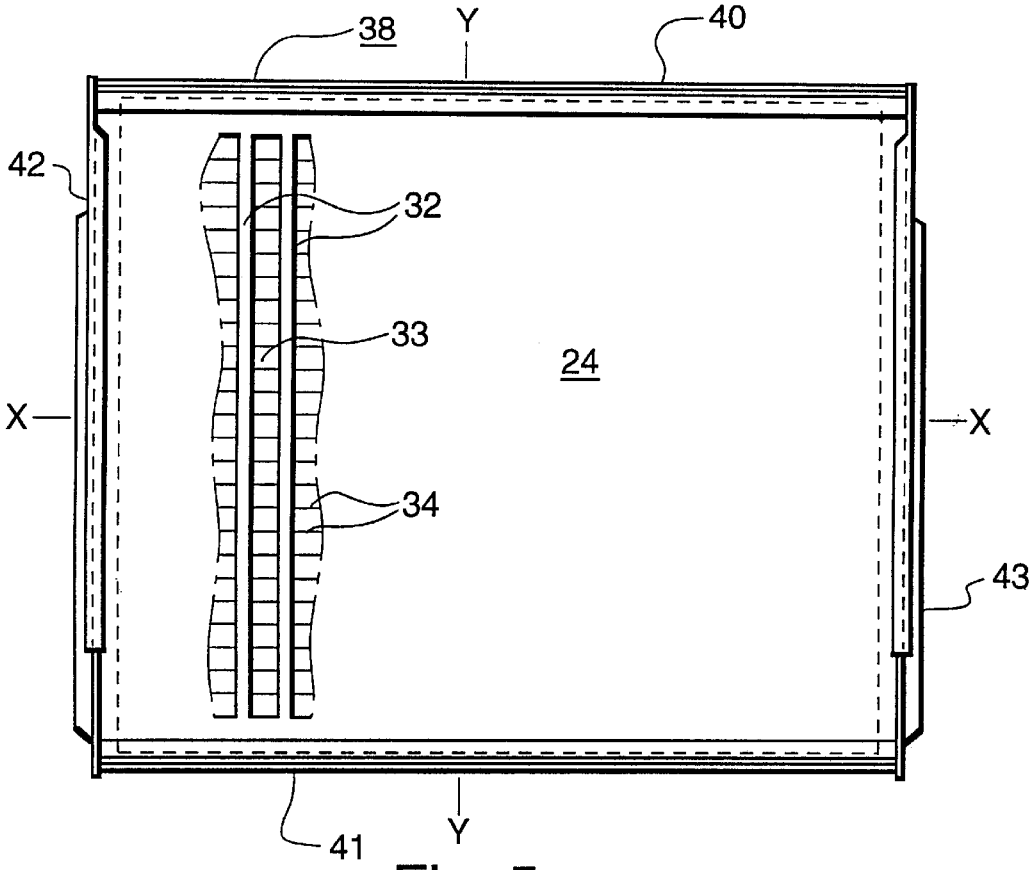
FIG. 5 is a plan view of a tension focus mask and frame used in the CRT of FIG. 3.

The CRT 10 is designed to be used with an external magnetic deflection yoke, such as the yoke 30, shown in the neighborhood of the funnel-to-neck junction. When activated, the yoke 30 subjects the three beams to magnetic fields that cause the beams to scan a horizontal and vertical rectangular raster over the screen 22. As is known in the art, an aluminum layer (not shown) overlies the screen 22 and provides an electrical contact thereto, as well as a reflective surface to direct light, emitted by the phosphors, outwardly through the viewing faceplate 18. As shown in FIG. 5, the tension focus mask 24 is formed, preferably, from a thin rectangular sheet of about 0.05 mm (2 mil) thick low carbon steel, that includes two long sides and two short sides. The two long sides of the tension focus mask parallel the central major axis, X, of the mask and the two short sides parallel the central minor axis, Y, of the mask. With reference to FIGS. 4 and 5, the tension focus mask 24 includes an apertured portion that contains a plurality of first elongated strands 32 separated by slots 33 that parallel the minor axis, Y, of the mask. In one configuration, the mask pitch, $D_m$, defined as the transverse dimension of a first strand 32 and an adjacent slot 33, is 0.85 mm (33.5 mils). As shown in FIG. 4, each of the first strands 32 has a transverse dimension, or width, w, of about 0.39 mm (15.5 mils) and each of the slots 33 has a width, a', of about 0.46 mm (18 mils). The slots 33 extends from near one long side of the tension focus mask to near the other long side thereof. A plurality of second strands 34, each having a diameter of about 0.025 mm (1 mil), are disposed substantially parallel to the first strands 32 and spaced therefrom by insulators 36. As shown in FIG. 5, the frame 38 comprises four major members: two torsion members 40 and 41; and two side members 42 and 43. The two torsion members, 40 and 41, parallel the major axis, X, and each other. The long sides of the tension focus mask 24 are welded between the two torsion members 40 and 41 which provide the necessary tension to the mask 24. Again with reference to FIG. 4, the screen 22, formed on the viewing faceplate 18, includes the light-absorbing matrix 23 with rectangular openings in which the color emitting phosphor lines are disposed. The corresponding matrix openings have a width, c, of about 0.25 mm (6.1 mils). The width, d, of each matrix line is about 0.15 mm (5.8 mils) and each phosphor triad has a width or screen pitch, T, of about 0.91 mm (35.8 mils). For this embodiment, the tension focus mask 24 is spaced at a distance, Q, (hereinafter Q-spacing) of about 15.24 mm (600 mils) from the center of the interior surface of the faceplate panel 12. During operation of the CRT 10, the voltage difference between the first strands 32 and the second strands 34, at an anode voltage of 30 kV, is about 800 volts.

The pitch, $D_m$, of the tension focus mask 24 can be varied. For example, in a second configuration, with a mask pitch of 0.68 mm (25.6 mils) and a first strand width of 0.3 mm (11.8 mils), the corresponding screen pitch, T, is 0.68 mm (26.78 mils). Each matrix opening has a width, c, of about 0.11 mm (4.5 mils) and a matrix line width, d, of about 0.11 mm (4.5 mils). For this configuration of the tension focus mask 24, with a center Q-spacing of 11.56 mm (455 mils), the voltage difference between the first strands 32 and the second strands 34, at an anode voltage of 30 kV, is about 750 volts.

In a third configuration, with a mask pitch, $D_m$, of 0.41 mm (16.1 mils) and a first strand width of 0.2 mm (7.8 mils), the corresponding screen pitch, T, is 0.42 mm (16.5 mils). Each matrix opening has a width, c, of about 0.051 mm (2 mils) and a matrix line width, d, of about 0.089 mm (3.5 mils). For this configuration of the tension focus mask 24, with a center Q-spacing of 7.4 mm (291.5 mils), the voltage difference between the first strands 32 and the second strands 34, at an anode voltage of 30 kV, is about 650 volts.

The method of manufacturing the matrix 23 will be described in an embodiment using the tension focus mask 24 with a mask pitch, $D_m$, of 0.68 mm as a photographic master. Initially, the panel 12 is cleaned, as indicated in step 50 of FIG. 6A, by washing it with a caustic solution, rinsing it in water, etching it with buffered hydrofluoric acid and rinsing it again with water, as is known in the art. As indicated in step 52, the interior surface of the viewing faceplate 18 of the panel 12 is then coated with a polyvinyl alcohol (PVA) solution and dried to form a precoat layer 54, shown in FIG. 7. Because the chemical composition of the glass faceplate panel 12 may vary somewhat from one glass manufacturer to another, the precoat layer 54 provides a uniform surface condition for the deposition for subsequent materials. The thickness of the precoat layer 54 is on the order of a monolayer. A negative photoresist solution is overcoated onto the precoat layer 54 and dried to form a photoresist layer 56, as indicated in step 58. The photoresist solution comprises 1.08 wt. % of PVA; 1.08 wt. % PVP; 0.6 wt. % of a sensitizer, such as Diazo Resin #8, available from Fairmount Chemical Co., Inc., Newark, N.J., 0.02 wt. % of a surfactant, such as Triton X100, available from Union Carbide, Danbury, Conn.; and the balance, deionized (DI) water. The photoresist layer 56 has a thickness of about 1±0.2 μm. Then, an organic conductive solution is overcoated onto the photoresist layer 56 and dried to form an organic conductive (OC) layer 62, as indicated in step 60. The thickness of the OC layer 62 is about 1±0.2 μm. The OC solution comprises about 0.62 wt. % PVP; 5.84 wt. % MS-905, available from BASF, Parsippany, N.J.; and the balance, methanol. Next, as indicated in step 64, an organic photoconductive solution is provided to overcoat the OC layer 62 and dried to form an organic photoconductive layer (OPC) 66. The OPC layer 66 has a thickness of about 5±1 μm. The OPC solution comprises about 0.005 wt. % of the surfactant UL-7602, available from Union Carbide, Danbury, Conn.; about 0.23 wt. % of 2,4,7-trinitro-9-fluorenone (TNF); about 0.35 wt. % of 2-ethylanthraquinone (EAQ); about 2.32 wt. % of tetraphenylethylene (TPE); about 9.28 wt. % polystyrene; about 24.49 wt. % xylene; and the balance, toluene. Then, as indicated in step 68, a poly-2-vinylpyridine (PVPy) solution is applied to overcoat the OPC layer 66 and dried to form a protective layer 70, having a thickness of about 0.7±0.2 μm. The photoresist layer 56, the OC layer 62 and the OPC layer 66 are referred to hereinafter, collectively, as the photoreceptor 72.

The faceplate panel is then placed on a charging apparatus of the type described in U.S. Pat. No. 5,519,217, issued to Wilbur et al., on May 21, 1996, and the OPC layer 66 of the photoreceptor 72 is electrostatically charged to a positive voltage of 425±25V to provide a substantially uniform level of charge, as indicated in step 74. As indicated in step 76, the tension focus mask 24 is inserted into the faceplate panel 12 and mounted within a lighthouse, containing a plurality of light sources.

Figure 1:
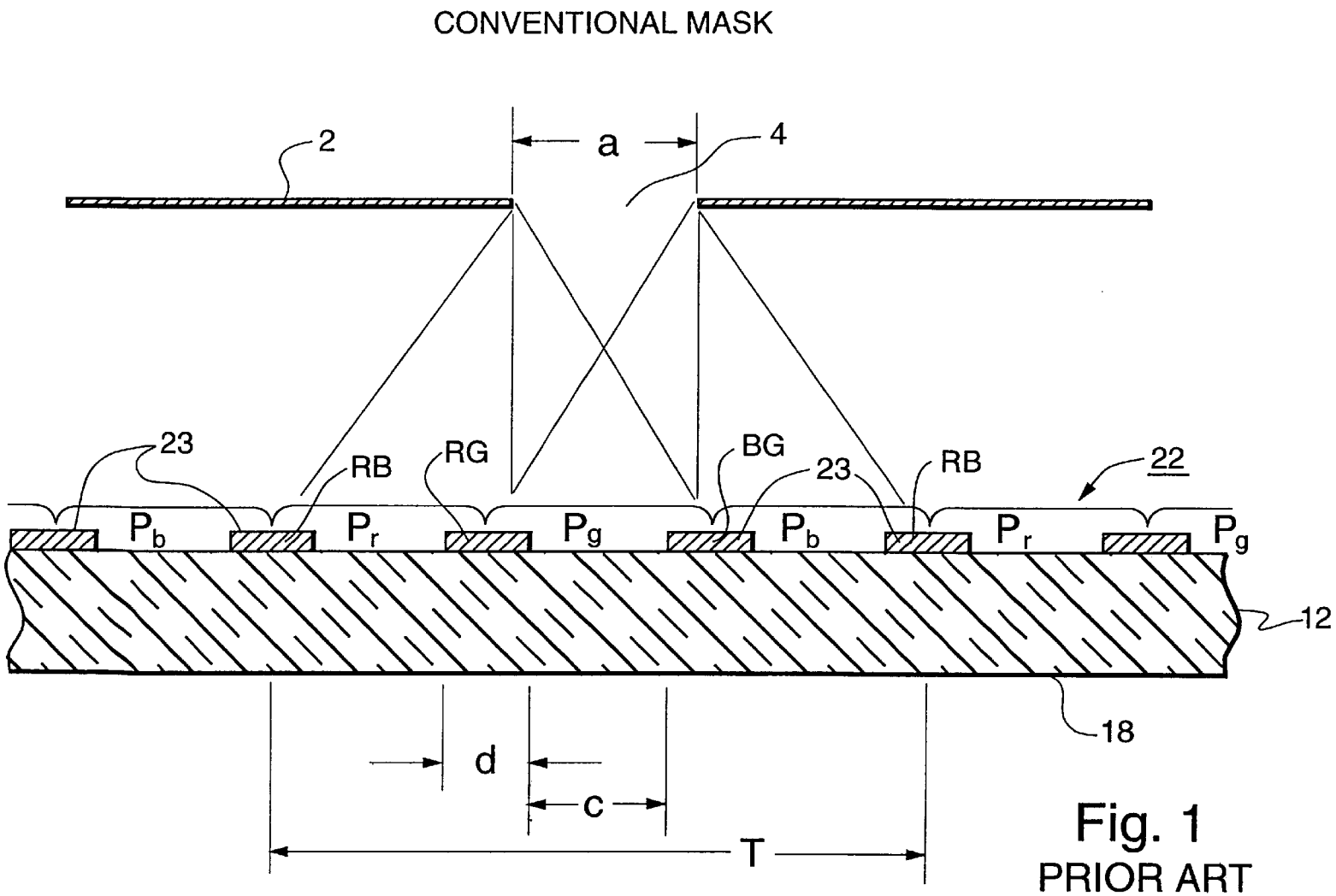
Fig. 1 PRIOR ART
FIG. 1 is an enlarged sectional view of a portion of a conventional shadow mask and screen of a CRT demonstrating "print-down"
Figure 2:
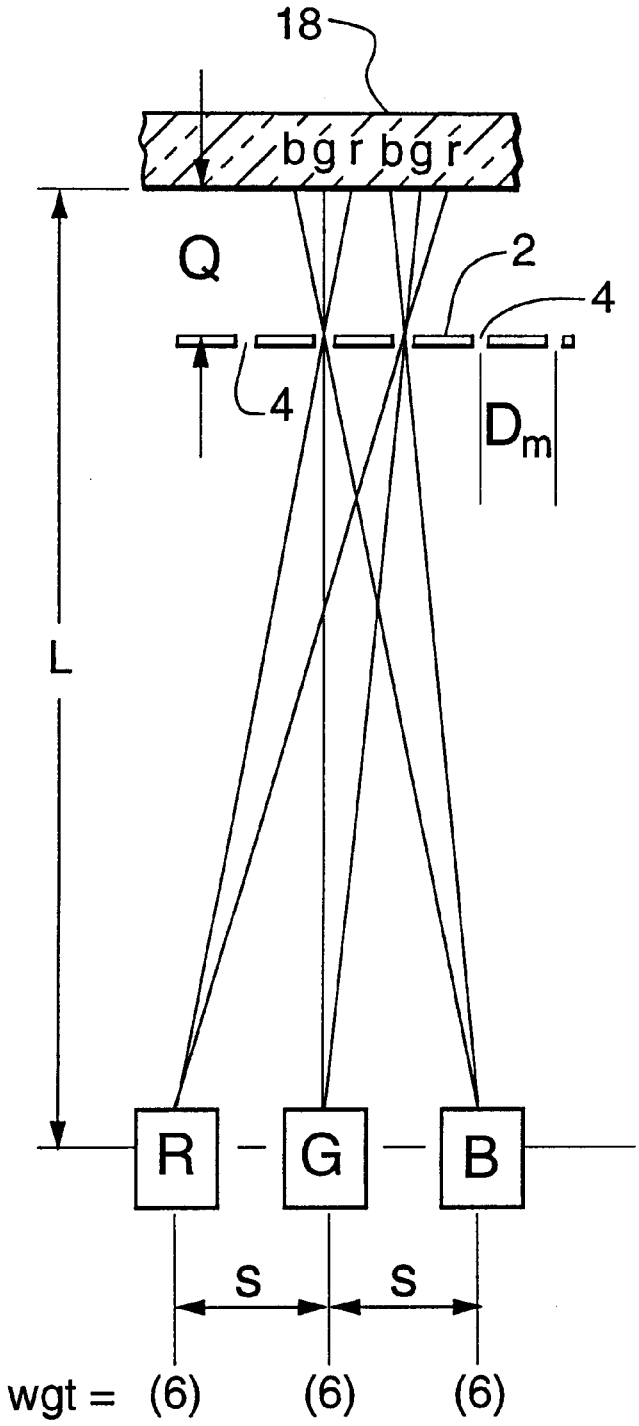
Fig. 2 PRIOR ART
FIG. 2 schematically shows a conventional three-in-one lighthouse exposure procedure used in conjunction with a shadow mask.

Unlike a conventional CRT in which the shadow mask 2 has openings 4, each with a width less than $D_m/3$, CRT's embodying the tension focus mask 24 may have an opening a' with a width between $D_m/3$ and $2D_m/3$. If one were to use the three light sources, R, G and B, shown in FIG. 2, to project an image of the mask openings 33 of FIG. 4, significant spatial overlap at the screen would occur. The result would be that the area of least exposure would be centered on the projected image of the opening 33, where it is intended that one of the phosphor stripes would eventually be centered. To avoid this problem all of the light source positions of FIG. 2 are laterally shifted, either left or right, by a distance, s/2, so that the light source, G, no longer lies on the symmetry axis of the screen and mask. When the light sources are shifted to the right, the mask-screen axis lies halfway between the shifted R and G light sources. Similarly, if the light sources are shifted to the left, the screen symmetry axis lies midway between the shifted G and B light sources. The light source geometries for the exposure procedures for a conventional CRT with a shadow mask and a CRT using a tension focus mask 24, are summarized as entries 1–3 of the TABLE. The TABLE indicates the light source locations and exposure weights (in parenthesis).

| | 1 | 2 | 3 | 4 | 5 | 6 | 7 | 8 |
|---|---|---|---|---|---|---|---|---|
| −5s/2 | | | | | | | G'(2) | G'(1) |
| −2s | | | | R'(6) | R'(2) | | | |
| −3s/2 | | | B(6) | | | R'(2) | R'(4) | R'(3) |
| −s | B(6) | | | | B(4) | | | |
| −s/2 | | B(6) | G(6) | | | B(4) | B(6) | B(5) |
| 0 | G(6) | | | G(6) | G(6) | | | |
| +s/2 | | G(6) | R(6) | | | G(6) | G(4) | G(5) |
| +s | R(6) | | | | R(4) | | | |
| +3s/2 | | R(6) | | | | R(4) | R(2) | R(3) |
| +2s | | | | B'(6) | B'(2) | | | |
| +5s/2 | | | | | | B'(2) | | B'(1) |

In the TABLE, column 1 indicates the light locations and exposure weights for the conventional CRT and shadow mask of FIG. 2. Column 2 represents a CRT using the tension focus mask 24 with the light locations left shifted, and column 3 represents the same tension focus mask 24 with the light locations right shifted.

The values of s used to set the locations of the light sources in a lighthouse are linked to the design values L, $D_m$, and $Q_0$. When a defective or unmatched shadow mask or tension focus mask exhibits location deformations from the specified surface shape $z_m(x, y)$, the error produces a local mask-screen spacing of the form $Q=Q_0+\epsilon$, while L remains fixed. The trio pitch $T_1$ at the screen becomes:

$$T_1=LD_m/[L-(Q_0+\epsilon)], \quad (3)$$

and the spacing $x_1$ between the image centers g and b and between the image centers r and g, expressed as a fraction of the $\epsilon$-dependent trio spacing, is given by the relation:

$$x_1/T_1=(Q_0+\epsilon)/3Q_0. \quad (4)$$

The lateral shift of the light sources required for printing screens for a CRT having a tension focus mask 24 affects only the reference position of the matrix stripes with respect to the mask openings 33. It has no influence on the stripe-to-stripe spacing, i.e., such shifting of the source does not change the screen structure elements or their relationship to each other, but rather laterally shifts them collectively with respect to the mask. Therefore, the spacing formulas of equations (3) and (4) apply to both conventional CRT and to CRT having the tension focus mask 24. For both types of tubes, errors of ±5% in the mask-screen or Q-spacing produce an unacceptable degree of non-uniformity in the spacing widths of the black stripes, or guardbands, of the matrix 23. Equation 4 provides a description of the center of the individual exposure profiles for a given source position. The equation is a very good approximation for the tension focus mask system, i.e., diffraction has little influence on the accuracy of the equation. Grouping or degrouping of a triad will be influenced by the summation of the exposure patterns; however, for a tension focus mask system with "Q" errors, the center of the individual exposure profiles described by equation 4 do not track the resultant grouping of degrouping. For example, the exposure sequence taught by the entry in column 8 of the TABLE yields grouping with short "Q" that is less severe than one may expect from equation 4 and, likewise, the degrouping with long "Q" is less severe than may expect from equation 4. Grouping refers to the tendency of the red and blue triad centers to move toward the green center with short Q-error (i.e., b, g and g, r<T/3 in FIG. 3). Degrouping refers to the tendency of the red and blue triad centers to move away from the green center with long Q-error (i.e., b, g and g, r>T/3 in FIG. 2).

Figure 8:
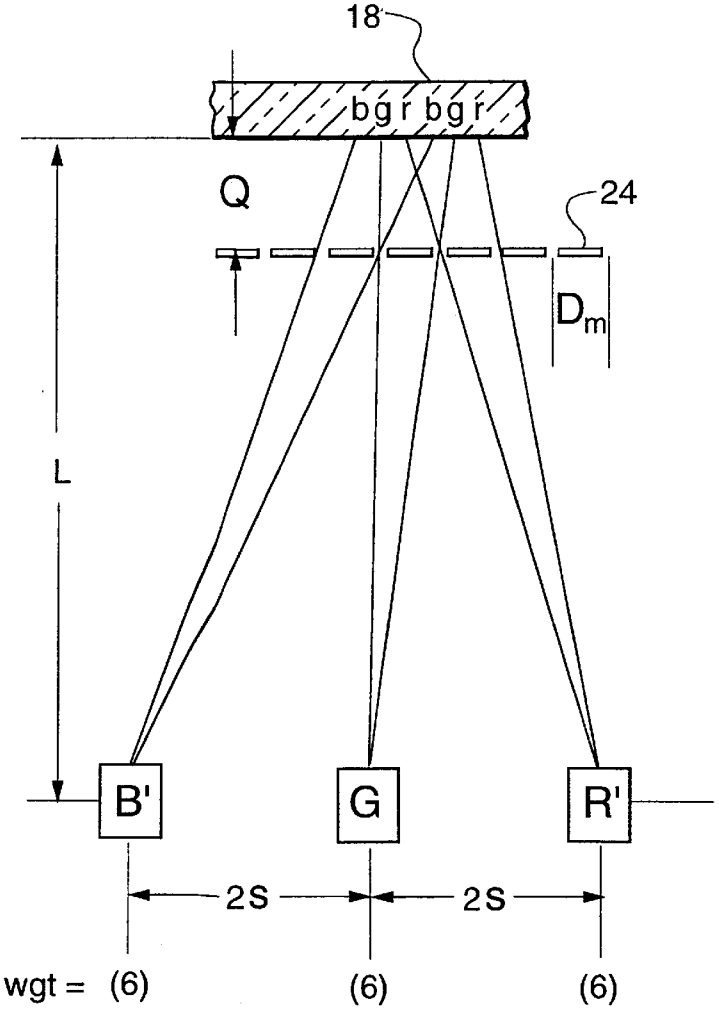
FIG. 8 schematically shows the exposure procedure described as the entry in column 4 of the TABLE.

With reference to FIG. 8, if two of the light source locations are denoted as B' and R', and are spaced a lateral distance 2 s from the G light source location, the projected images of the mask openings in each b, g, r trio at the screen are formed by light rays through three adjacent openings in the mask, rather than from the same opening, as in FIG. 2. For the design values L, $Q_0$, and $D_m$, the spacings between the images at the screen are the same as for the procedure of FIG. 2. An example of this exposure procedure for a conventional CRT is summarized as the entry in column 4 in the TABLE.

In the presence of Q-spacing errors, the light source configuration of FIG. 8 produces a trio spacing $T_2$ with the same Q-space dependence as $T_1$ in equation (3), but the fractional spacing $x_2/T_2$ between the image centers g and b, and between the image centers r and g, now has the form $$x_2/T_2=(Q_0-2\epsilon)/3Q_0. \quad (5)$$

With the new source locations, equation (5) states that the fractional image shifts for a given Q-error are twice as large as in equation (4), and are in the opposite directions.

For a composite exposure procedure in which the screen is given four exposure units from each light source in the configuration of FIG. 2, and an additional two exposure units from each light source location as in FIG. 8, the projected red and blue slit images experience twice the weight from the B and R source locations as from the R' and B' source locations. Additionally, the composite image, contributed by all light sources associated with a given color, receives the same total exposures of six units, as in the conventional practice. In the presence of Q-error, the motions of the red-image and the blue-image centroids from the weighted type 1 and type 2 exposures cancel each other in the combined exposure. For sufficiently small Q-errors, on the order of ±5% or less, the contrast level of the composite red or blue image decreases somewhat, but the peak location and exposure width remain relatively fixed, and exhibit acceptably small errors.

Figure 9:
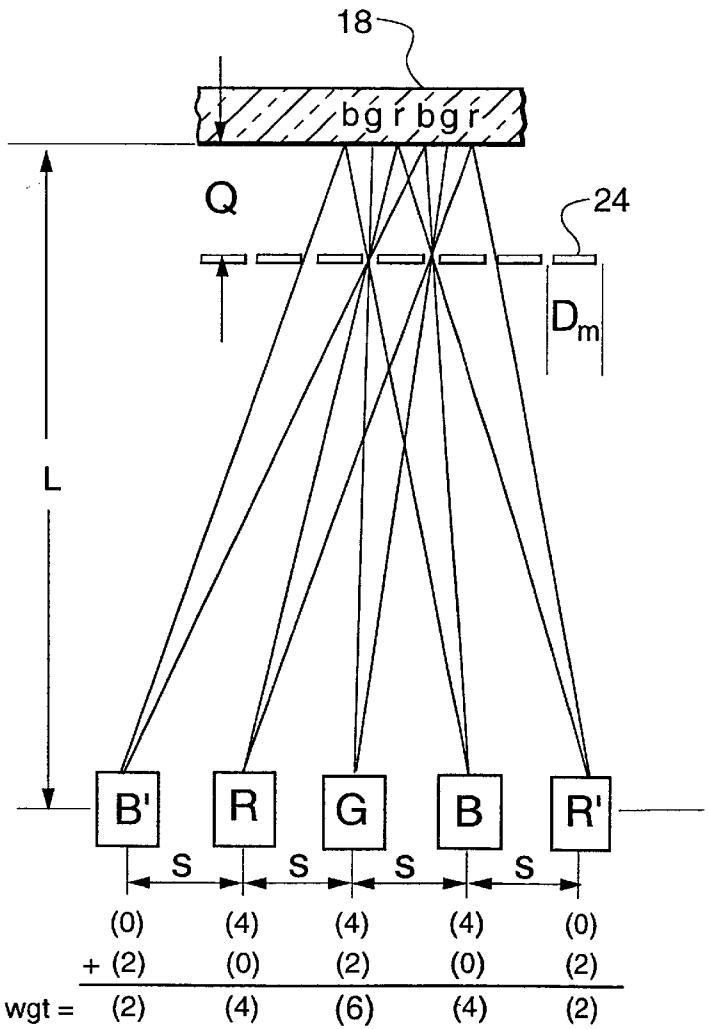
FIG. 9 schematically shows the exposure procedure described as the entry in column 6 of the TABLE.

FIG. 9 illustrates the composite exposure procedure that minimizes the matrix stripe grouping or de-grouping problems resulting from small Q-spacing errors. The composite exposure pattern assigns relative exposure weights of two units from B', four units from R, six units from G, four units from B, and two units from R'. The procedure is summarized in column 5 of the TABLE.

As previously noted, the lateral shift of the light sources required for the CRT having the tension focus mask 24 affects only the reference position of the matrix stripes with respect to the mask slits or openings 33, and has no influence on the matrix opening parity. Matrix opening parity refers to the condition in which the matrix openings in a given triad are equal in width. Consequently, shifting the array of the five light sources in FIG. 9 by a lateral distance of s/2, as summarized for a left shift in column 6 of the TABLE minimizes the grouping problem, for a CRT having a tension focus mask, in the presence of Q-errors. In this example, the mask-screen symmetry axis lies midway between light sources G and B. Alternatively, the exposure pattern may be shifted right by a lateral distance s/2 for the same tube type, as summarized in column 7 of the TABLE.

The weighted 5-position exposure significantly aids in compensating for stripe-to-stripe spacing errors, and is found adequate for this purpose in the screen fabrication process for CRT having a tension focus mask. However, the overall exposure directions in the lighthouse are not symmetrical about the normal to the screen center, which is also the symmetry axis for the in-line electron gun assembly of the CRT. A 6-position composite exposure which exhibits such symmetry about the electron gun and screen axis can be obtained by halving the weights of the light sources in the exposures of columns 6 and 7 of the TABLE, and combining the two sequences. The results are shown in FIG. 10 and summarized in column 8 of the TABLE.

Figure 6A:
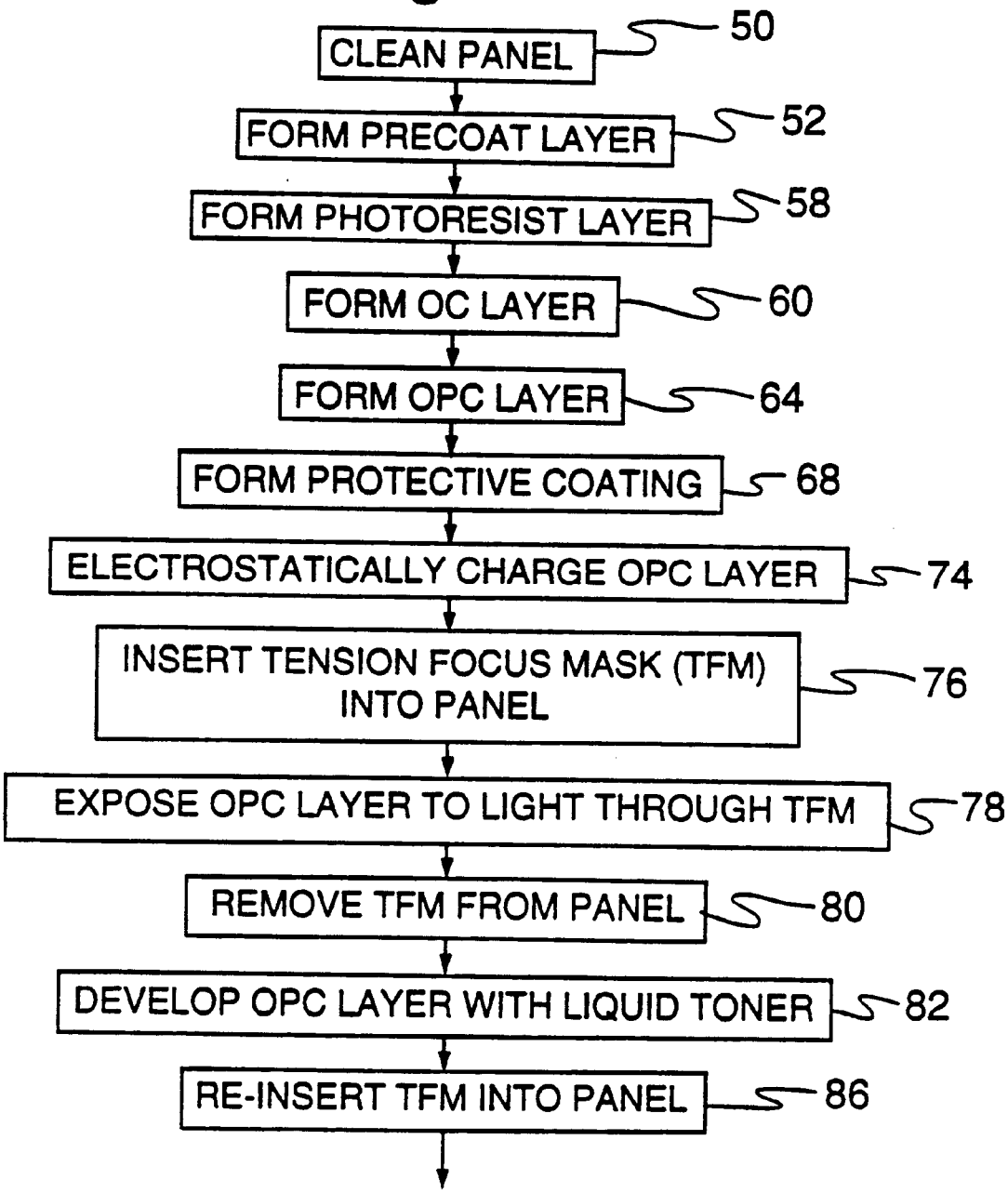
FIG. 6A is a partial view of a flow chart of the manufacturing process of the present invention.
Figure 10:
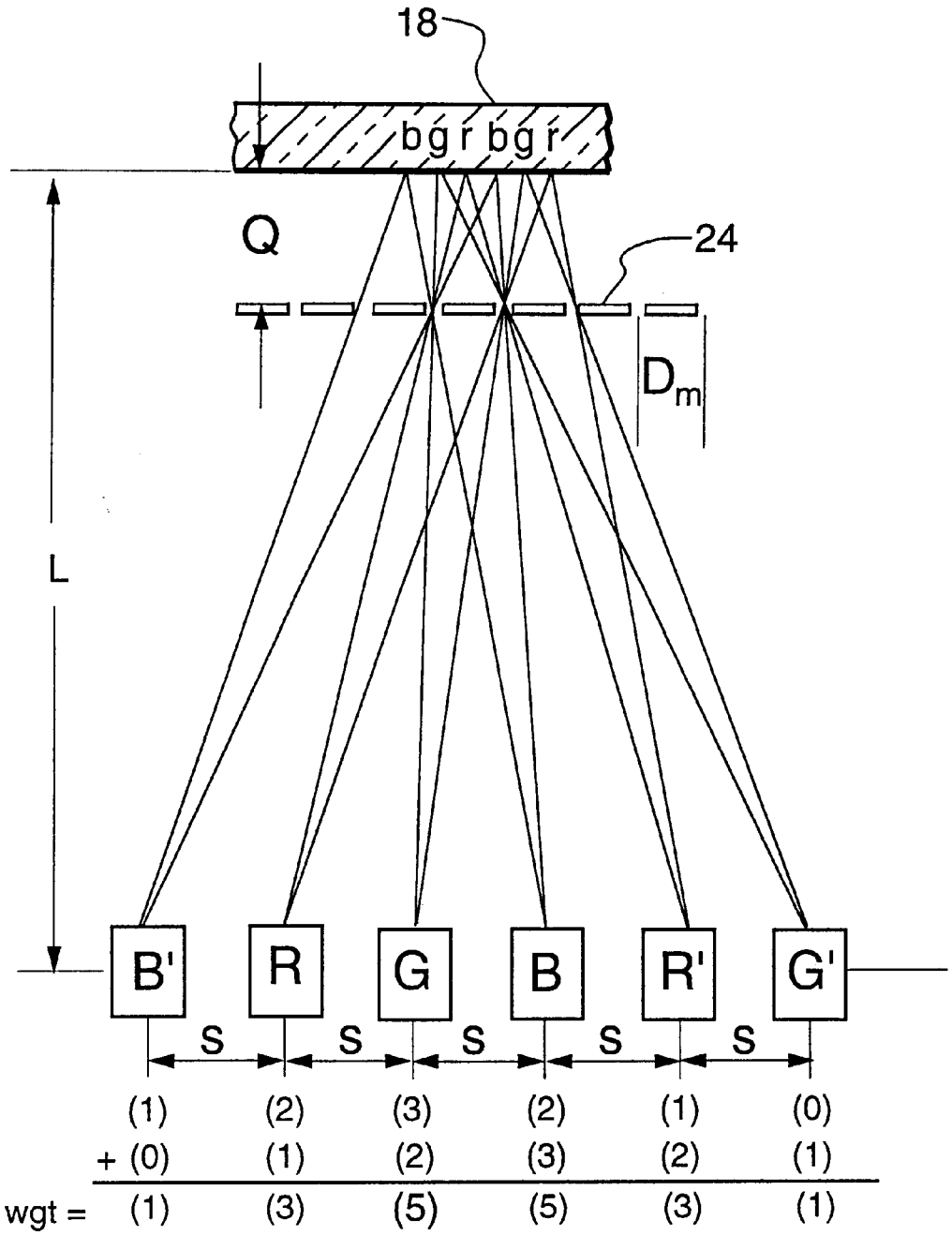
FIG. 10 schematically shows the exposure procedure described as the entry in column 8 of the TABLE.

As indicated in step 78 of FIG. 6A, using one of the procedures of either FIGS. 9 or 10, a xenon light source within the lighthouse exposes the OPC layer 66 of the photoreceptor 72 to light, which passes through the plurality of rectangular openings 33 in the tension focus mask 24, to selectively discharge the more intensely illuminated areas of the OPC layer 66 of the photoreceptor 72, without completely discharging the less intensely illuminated areas. Because the intensity of the xenon light source is substantially less than that of a conventional mercury source, the underlying photoresist layer 56 of the photoreceptor 72 is substantially unaffected by this light exposure. Typically, the exposure voltage contrast between the more intensely illuminated and less intensely illuminated areas of the OPC layer 66 is about 50–75 volts.

Figure 7:
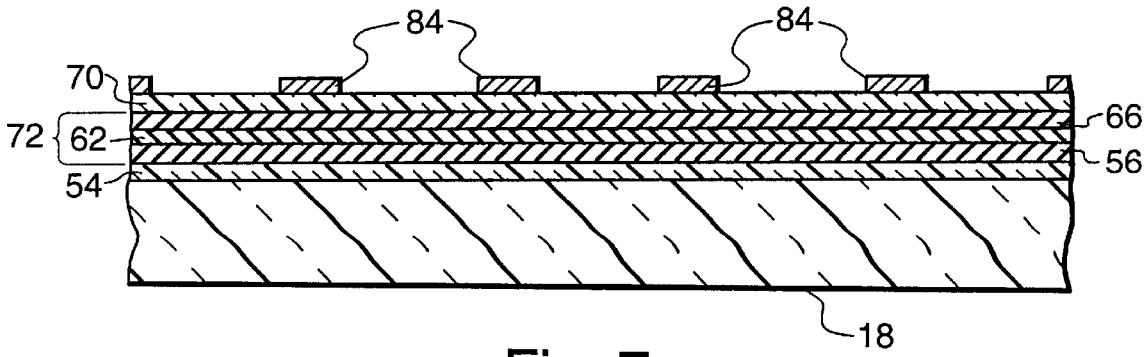
FIG. 7 is an enlarged sectional view of a portion of a viewing faceplate having a plurality of layers formed thereon during successive steps in the matrix manufacturing process.

After the exposure step, the tension focus mask 24 is removed from the panel 12, as indicated by step 80, and the OPC layer 66 is developed, in step 82, using a suitable liquid toner. The toner comprises negatively charged pigment particles suspended in an insulating liquid, such as isopar type H or G. The toner may be applied as a limp stream or by immersion. During application, the negatively charged toner particles follow the electrostatic field lines and settle on the protective layer 70 overlying the positively charged, less intensely illuminated, areas of the OPC layer 66. The excess liquid toner is removed from the panel 12, for example by gravity flow, or pouring, and the resultant toner lines 84, shown in FIG. 7, are dried. It has been determined that the exposure dose, i.e., the number of xenon lamp flashes, directly affects the width of the toner lines. The width of the lines generally decreases as the exposure dosage increases. Toner pattern development time, which also affects the width of the toner lines 84, is related to the conductivity of the toner, which, in turn, is dependent on the concentration of the pigment solids in the toner solution. The preferred pigment, available from Olin Corporation, Cheshire, Conn., comprises carbon particles having a concentration within the range of 0.3 to 2.0 weight percent. Toner lines having the necessary density and opacity can be obtained with a liquid toner having a conductivity of about 0.88 picosiemens/cm (pS/cm), a charge-to-mass ratio of about 9 microcoulombs/gram ($\mu$C/gm), and a particle size of about 430 nm.

Figure 6B:
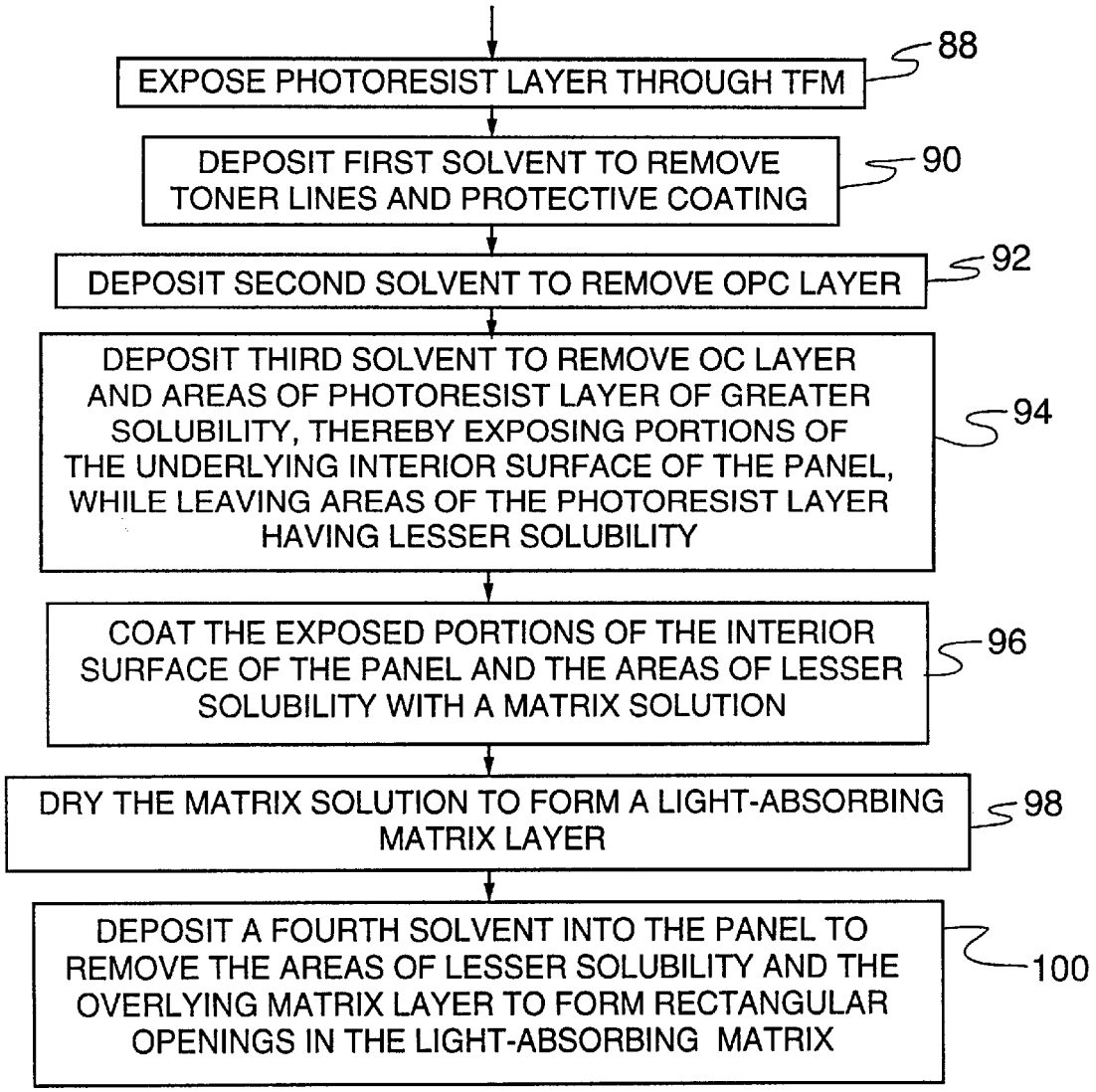
FIG. 6B is a partial view of a flow chart of the manufacturing process of the present invention, which, with FIG. 6A, is intended to form one complete view of the manufacturing process.

As indicated by step 86, the tension focus mask 24 is re-inserted into the faceplate panel 12 and mounted within a lighthouse having a mercury arc source which provides a UV output. Then, as indicated in step 88, of FIG. 6B, the UV radiation source within the lighthouse flood exposes the photoresist layer 56 of the photoreceptor 72 to UV radiation. The UV radiation passes through the plurality of rectangular openings 33 in the tension focus mask 24 and through the protective layer 70, the OPC layer 66, and the OC layer 62, to selectively change the solubility of the photoresist layer 56 of the photoreceptor 72. The non-illuminated areas of the photoresist layer 56, underlying the toner lines 84, are unaffected by the UV exposure and retain their solubility, while the illuminated areas of the photoresist layer between toner lines are rendered less soluble. During the UV exposure, the UV source within the lighthouse is oscillated to prevent the first strands 32 of the tension focus mask 24 from forming a pattern on the photoresist layer 56.

The toner lines 84 and the various layers 54, 56, 62, 66 and 70, disposed on the interior surface of the panel 12, are serially developed in order to expose portions of the interior surface of the viewing faceplate 18. As indicated in step 90, a suitable quantity of a first solvent is poured into the panel and sloshed for about two minutes to remove the toner lines and the protective layer 70. Preferably, the first solvent is selected from the group consisting of isopropanol (IPA), an aqueous solution of sulfamic acid (15%), or periodic acid (10%). Then, the panel is tilted into a vertical position to drain the solvent, toner and protective layer residue. While in the vertical position, if IPA has been used, an additional quantity, for example about 200 ml, of IPA is dispensed into the panel and allowed to drain out, after which the panel sidewall 20 is wiped dry to remove any residue and the panel is dried. The removal of the OPC layer 66 is accomplished, as indicated in step 92, by depositing a second solvent, preferably 400 ml of a 2:1 mixture, by volume, of toluene and methyl isobutyl ketone (MIBK), or alternatively, a suitable quantity of d-limonene. The mixture is sloshed around the interior of the panel for about seven minutes to dissolve the OPC layer 66 and then the panel is tipped to pour out the solvent mixture and OPC residue. If d-limonene is used, then no additional treatment is required prior to photoresist development; however, if the mixture of toluene and MIBK is used, then an additional 200 ml of toluene is squirted into the panel while it is in a vertical position for draining, and the sidewall 20 is wiped dry to remove any residue. Because the OC layer 62 and the unexposed areas of the photoresist layer 56 are soluble in water, the development of the photoresist layer, as described in step 94, is accomplished by rinsing the interior surface of the panel 12 with a third solvent, such as water, to remove the OC layer and the areas of the photoresist layer having greater solubility. This development step exposes portions of the underlying areas of the interior surface of the panel 12, while leaving intact the areas of the photoresist layer 56 having lesser solubility. The matrix is formed, as indicated in step 96, by coating the exposed portions of the interior surface of the panel 12 and the retained areas of the photoresist layer 56, having lesser solubility, with an aqueous graphite suspension, of the type described in the above-referenced U.S. Pat. No. 3,558,310. The suspension is dried to form a light-absorbing matrix 23, as indicated in step 98, and developed, in step 100, by depositing a fourth solvent, such as aqueous periodic acid, or the equivalent, onto the matrix to soften and swell the underlying, retained areas of the photoresist layer 56 having lesser solubility. The matrix is then flushed with water to remove the loosened, less soluble, retained areas of the photoresist layer and the overlying matrix thereon, forming openings therein, but leaving the matrix lines or guardbands attached to the exposed portion of the interior surface of the panel 12.

The faceplate panel is now ready for the formation of the phosphor screen, using the EPS process described in U.S. Pat. No. 4,721,767.

While the photoresist layer 56 and the OC layer 62 have been described herein as separate layers, it is within the scope of this invention to provide a single layer having both photoresist and conductive properties. Also, the invention encompasses a suitable development of charged pigment onto the more intensely illuminated areas of the photoreceptor.

What is claimed is:

1. A method of manufacturing a light-absorbing matrix having a plurality of openings formed therein on an interior surface of a faceplate panel of a cathode-ray tube, comprising the steps of:

a) forming a photoreceptor, having a plurality of layers including a photoresist layer, a conductive layer, and a photoconductive layer, on said interior surface of said faceplate panel;

b) electrostatically charging said photoreceptor to a substantially uniform level of charge;

c) inserting a color selection electrode into said panel, said color selection electrode having a major axis and a minor axis with a plurality of openings each having a first transverse dimension along said major axis;

d) exposing said photoreceptor to light, through said plurality of openings in said color selection electrode, to selectively discharge the more intensely illuminated areas of said photoreceptor, without substantially discharging the less intensely illuminated areas thereof;

e) removing said color selection electrode from said panel;

f) contacting said photoreceptor with a suitable liquid toner to form a plurality of toner locations, said toner comprising pigment particles having a charge opposite in polarity to the charge on the less intensely illuminated areas of said photoreceptor;

g) reinserting said colorselection electrode into said panel;

h) re-exposing said photoreceptor to light to selectively change the solubility of said photoresist portion of said photoreceptor, thereby creating in said photoresist portions areas of greater solubility underlying said toner locations and areas of lesser solubility therebetween;

i) serially developing said photoreceptor to expose portions of said interior surface of said panel, while leaving said areas of lesser solubility;

j) coating said exposed portions of said interior surface of said panel and said areas of lesser solubility with a matrix suspension;

k) drying said matrix suspension to form a light-absorbing matrix; and l) contacting said light-absorbing matrix with a solvent to remove said areas of lesser solubility and the overlying light-absorbing matrix thereon, without removing said light-absorbing matrix from the exposed portions of said interior surface of said panel, thereby forming, in said light-absorbing matrix, said plurality of openings each having a second transverse dimension along said major axis, whereby said first transverse dimension of said openings in said color selection electrode is substantially greater than said second transverse dimension of said openings in said matrix.

2. The method as described in claim 1, further including, prior to step a), the substep of coating said interior surface of said faceplate panel with a PVA solution to form a precoat layer.

3. The method as described in claim 2, where step a) includes the substeps of:

I) overcoating said precoat layer with a photoresist solution to form said photoresist layer;

II) overcoating said photoresist layer with an organic conductive solution to form an organic conductive (OC) layer;

III) overcoating said OC layer with an organic photoconductive solution to form an organic photoconductive (OPC) layer; and IV) applying a PVPy solution to said OPC layer to form a protective coating thereon.

4. The method as described in claim 3, wherein step i), which recites serially developing said photoreceptor to expose portions of said interior surface of said panel while leaving said areas of lesser solubility, includes:

depositing a first solvent into said panel to remove said toner locations and said protective coating;

depositing a second solvent into said panel to remove said OPC layer, and depositing a third solvent into said panel to remove said OC layer and said areas of greater solubility of said photoresist layer, thereby exposing portions of said interior surface of said panel, while leaving intact said areas of said photoresist layer of lesser solubility.

5. The method as described in claim 4, wherein said first solvent is selected from the group consisting of IPA, an aqueous solution of sulfamic acid (15%), and periodic acid (10%).

6. The method as described in claim 4, wherein said second solvent is selected from the group consisting of a mixture of toluene and MIBK, and D-limonene.

7. The method as described in claim 4, wherein said third solvent is water.

8. The method as described in claim 2, where step a) includes the substeps of:

I) overcoating said precoat layer with a suitable solution to form a single photoresist and OC layer;

II) overcoating said single photoresist and OC layer with an organic photoconductive solution to form an organic photoconductive (OPC) layer; and III) applying a PVPy solution to said OPC layer to form a protective coating thereon.

9. A method of manufacturing a light-absorbing matrix having a plurality of rectangular matrix openings formed therein on an interior surface of a faceplate panel of a cathode-ray tube, comprising the steps of:

coating said interior surface of said faceplate panel with a PVA solution to form a precoat layer;

overcoating said precoat layer with a photoresist solution to form a photoresist layer;

overcoating said photoresist layer with an organic conductive solution to form an organic conductive (OC) layer;

overcoating said OC layer with an organic photoconductive solution to form an organic photoconductive (OPC) layer;

applying a PVPy solution to form a protective overcoating on said OPC layer;

electrostatically charging said OPC layer to a substantially uniform level of charge;

inserting, into said panel, a tension focus mask having a major axis and a minor axis with a plurality of rectangular slots which are parallel to said minor axis, said slots having a first width which is parallel to said major axis;

exposing to light said OPC layer, through said plurality of rectangular slots in said tension focus mask, from at least five light locations, to selectively discharge the more intensely illuminated areas of said OPC layer, without substantially discharging the less intensely illuminated areas of said OPC layer;

removing said tension focus mask from said panel;

contacting said OPC layer with a suitable liquid toner, having charged pigment particles therein, to form a plurality of toner lines on the less intensely illuminated areas of said OPC layer, said pigment particles having a charge opposite in polarity to the charge on the less intensely illuminated areas of said OPC layer;

reinserting said tension focus mask into said panel;

flood exposing said photoresist layer underlying said protective layer, said OPC layer and said OC layer, to UV radiation to selectively change the solubility thereof, thereby creating in said photoresist layer areas of greater solubility underlying said toner lines and areas of lesser solubility therebetween;

depositing a first solvent into said panel to remove said toner lines and said protective coating;

depositing a second solvent into said panel to remove said OPC layer;

depositing a third solvent into said panel to remove said OC layer and said areas of said photoresist layer of greater solubility, thereby exposing portions of the underlying interior surface of said panel, while leaving intact said areas of said photoresist layer of lesser solubility;

coating said exposed portions of said interior surface of said panel and said areas of said photoresist layer of lesser solubility with a matrix suspension;

drying said matrix suspension to form a layer of said light-absorbing matrix; and depositing a fourth solvent into said panel to remove said areas of said photoresist layer of lesser solubility and the overlying matrix thereon, thereby forming in said light-absorbing matrix a plurality of rectangular openings having a second width which is parallel to said major axis, whereby the first width of said rectangular slots in said tension focus mask is substantially greater than the corresponding second width of said rectangular openings in said matrix.

10. The method as described in claim 9, wherein said first solvent is selected from the group consisting of IPA, an aqueous solution of sulfamic acid (15%), and periodic acid (10%).

11. The method as described in claim 9, wherein said second solvent is selected from the group consisting of a mixture of toluene and MIBK, and D-limonene.

12. The method as described in claim 9, wherein said third solvent is water.

13. The method as described in claim 9, wherein said fourth solvent is aqueous periodic acid.

14. A method of manufacturing a light-absorbing matrix having a plurality of rectangular matrix openings formed therein on an interior surface of a faceplate panel of a cathode-ray tube, comprising the steps of:

coating said interior surface of said faceplate panel with a PVA solution to form a precoat layer;

combining a photoresist and organic conductive solution to form a photoresist-conductive layer;

overcoating said photoresist-conductive layer with an organic photoconductive solution to form an organic photoconductive (OPC) layer;

applying a PVPy solution to form a protective overcoating on said OPC layer;

electrostatically charging said OPC layer to a substantially uniform level of charge;

inserting, into said panel, a tension focus mask having a major axis and a minor axis with a plurality of rectangular slots which are parallel to said minor axis, said slots having a first width which is parallel to said major axis;

exposing to light said OPC layer, through said plurality of rectangular slots in said tension focus mask, from at least five light locations, to selectively discharge the more intensely illuminated areas of said OPC layer, without substantially discharging the less intensely illuminated areas of said OPC layer;

removing said tension focus mask from said panel;

contacting said OPC layer with a suitable liquid toner, having charged pigment particles therein, to form a plurality of toner lines on the less intensely illuminated areas of said OPC layer, said pigment particles having a charge opposite in polarity to the charge on the less intensely illuminated areas of said OPC layer;

reinserting said tension focus mask into said panel;

flood exposing said photoresist-conductive layer underlying said protective layer, and said OPC layer, to UV radiation to selectively change the solubility thereof, thereby creating in said photoresist-conductive layer areas of greater solubility underlying said toner lines and areas of lesser solubility therebetween;

depositing a first solvent into said panel to remove said toner lines and said protective coating;

depositing a second solvent into said panel to remove said OPC layer;

depositing a third solvent into said panel to remove areas of said photoresist-conductive layer of greater solubility, thereby exposing portions of the underlying interior surface of said panel, while leaving intact said areas of said photoresist-conductive layer of lesser solubility;

coating said exposed portions of said interior surface of said panel and said areas of said photoresist-conductive layer of lesser solubility with a matrix suspension;

drying said matrix suspension to form a layer of said light-absorbing matrix; and depositing a fourth solvent into said panel to remove said areas of said photoresist-conductive layer of lesser solubility and the overlying matrix thereon, thereby forming in said light-absorbing matrix a plurality of rectangular openings having a second width which is parallel to said major axis, whereby the first width of said rectangular slots in said tension focus mask is substantially greater than the corresponding second width of said rectangular openings in said matrix.

* * * * *